US011718903B2

(12) United States Patent
Qiao et al.

(10) Patent No.: US 11,718,903 B2
(45) Date of Patent: Aug. 8, 2023

(54) PREPARATION METHOD OF MULTI-FUNCTIONAL MARINE ENGINEERING ALLOY

(71) Applicants: Shandong Laboratory of Yantai Advanced Materials and Green Manufacturing, Yantai (CN); Yantai Zhongke Research Institute of Advanced Materials and Green Chemical Engineering, Yantai (CN); Lanzhou Institute of Chemical Physics, Chinese Academy of Sciences, Lanzhou (CN)

(72) Inventors: Zhuhui Qiao, Yantai (CN); Yuan Yu, Yantai (CN); Weimin Liu, Yantai (CN); Huaguo Tang, Yantai (CN); Lujie Wang, Yantai (CN); Tongyang Li, Yantai (CN); Lin Song, Yantai (CN); Youjian Zhang, Yantai (CN)

(73) Assignees: Shandong Laboratory of Yantai Advanced Materials and Green Manufacturing, Yantai (CN); Yantai Zhongke Research Institute of Advanced Materials and Green Chemical Engineering, Yantai (CN); Lanzhou Institute of Chemical Physics, Chinese Academy of Sciences, Lanzhou (CN)

( * ) Notice: Subject to any disclaimer, the term of this patent is extended or adjusted under 35 U.S.C. 154(b) by 0 days.

(21) Appl. No.: 17/810,703

(22) Filed: Jul. 5, 2022

(65) Prior Publication Data

US 2023/0002875 A1 Jan. 5, 2023

(30) Foreign Application Priority Data

Jul. 5, 2021 (CN) ..... 202110757829.6

(51) Int. Cl.
*C22C 38/42* (2006.01)
*C22C 33/02* (2006.01)
*C22C 33/00* (2006.01)

(52) U.S. Cl.
CPC ..... *C22C 38/42* (2013.01); *C22C 33/006* (2013.01); *C22C 33/0207* (2013.01)

(58) Field of Classification Search
None
See application file for complete search history.

(56) References Cited

PUBLICATIONS

Verma, et al., "High temperature wear in CoCrFeNiCux high entropy alloys: The role of Cu," Scripta Materialia 161, 2019, pp. 28-31.

(Continued)

*Primary Examiner* — Anthony M Liang
(74) *Attorney, Agent, or Firm* — DLA Piper LLP (US)

(57) ABSTRACT

The present disclosure discloses a preparation method of a multi-functional marine engineering alloy. Through the coupling of a multi-principal alloy structure, structural entropy, and temperature and powder metallurgy and heat treatment, mutual solubility between elements and free energy of an alloy system are regulated, Cu grain boundary segregation is eliminated, and uniform and dispersed nano-precipitation of the anti-fouling element Cu in corrosion-resistant and high-plasticity multi-principal alloys is realized. The preparation method is simple and controllable to operate, and the prepared material has plasticity higher than 75%, high yield strength, excellent corrosion resistance and anti-fouling property, and has important application prospects in the field of marine engineering.

6 Claims, 13 Drawing Sheets

(56) References Cited

PUBLICATIONS

Chinese Patent Application No. 202110757829.6, Notification to Grant Patent Right for Invention, dated Mar. 2, 2022, 2 pages.
Chinese Patent Application No. 202110757829.6, First Office Action, dated Oct. 29, 2021, 8 pages.

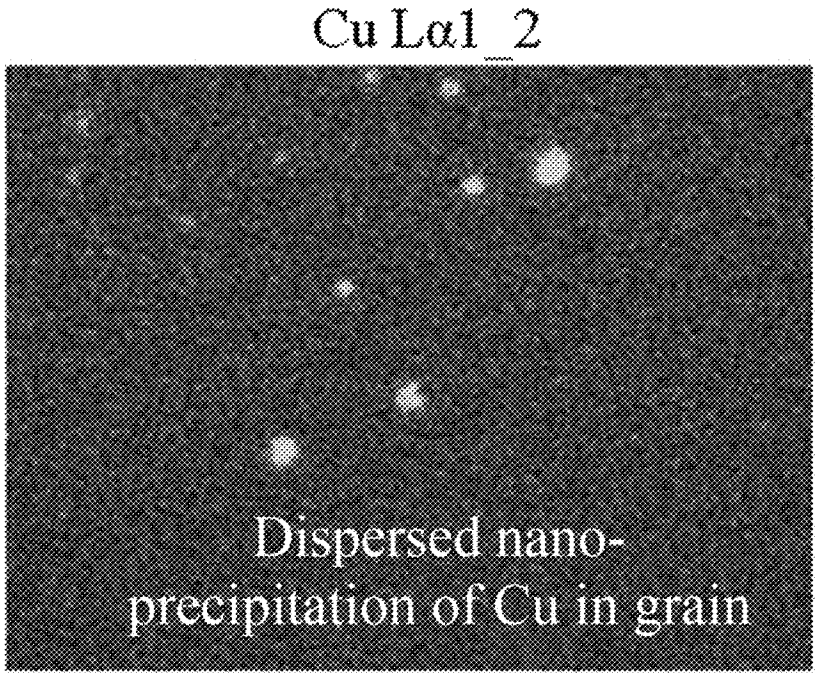
FIG. 3C
FIG. 3D
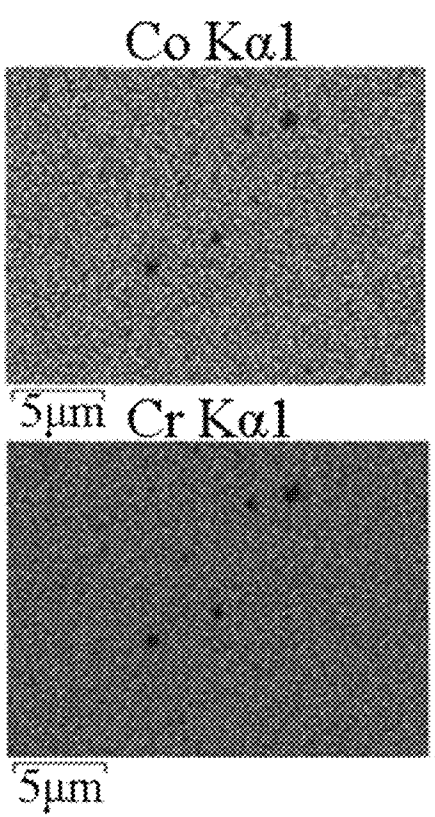
FIG. 3E
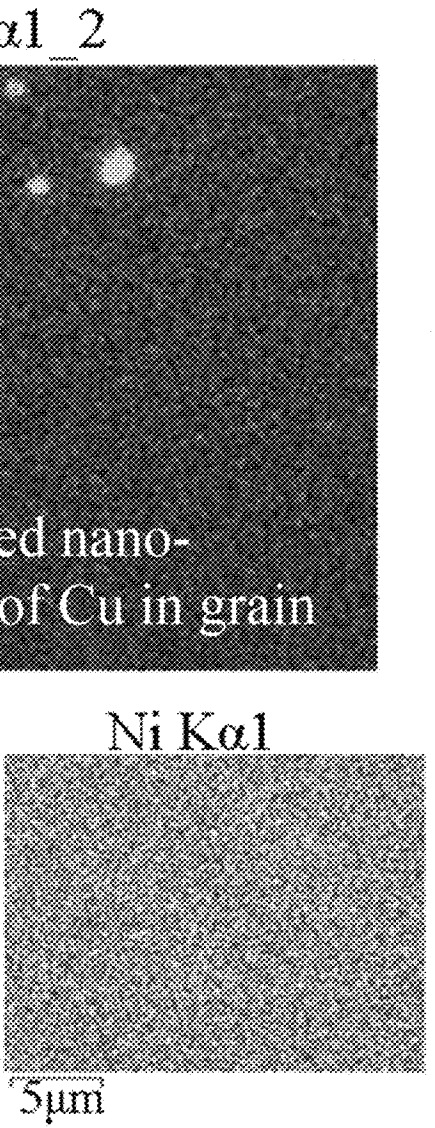
FIG. 3B
FIG. 3A

PREPARATION METHOD OF MULTI-FUNCTIONAL MARINE ENGINEERING ALLOY

CROSS REFERENCE TO RELATED APPLICATIONS

This application claims priority to Chinese Patent Application No. 202110757829.6, filed Jul. 5, 2021, which is herein incorporated by reference in its entirety.

TECHNICAL FIELD

The present disclosure relates to the technical field of marine metal materials, and in particular, to a preparation method of a multi-functional marine engineering alloy.

BACKGROUND ART

At present, international resources and strategic competition have expanded from land to sea and space. China has a vast ocean area, and the development of marine resources is crucial to the sustainable development of China's economy and people's livelihood and the stability of China's international status. The important direction of China's marine development is the deep sea and polar regions. The marine environment in the deep sea and polar regions is complex, and the equipment service conditions are harsh: the deep sea and polar regions have low temperatures, which can cause metal brittleness. Seawater can corrode metals. Marine microorganisms can attach to metal surfaces, accelerate corrosion, and increase movement resistance. The coating surface technology can improve corrosion resistance and anti-fouling property, but requires constant replenishment and cannot meet the long-life and reliable operation of critical components. Therefore, to realize the smooth development of China's marine industry, it is urgent to develop marine engineering metal materials with high plasticity, strong corrosion-resistance, and excellent anti-fouling property.

In metal materials, the Cu element and the Ag element have excellent anti-fouling properties. The Cu element is the first choice for marine anti-fouling metals in terms of cost. The property improvement of metals with high Cu content is a feasible method to realize the development of multi-functional marine engineering metals. To improve the property of metals with high Cu content, two problems need to be overcome: 1, the Cu element is chemically inert and is prone to grain boundary segregation in corrosion-resistant alloys. Grain boundary segregation can not only increase the enthalpy of the grain boundary and deteriorate the plasticity of the material but also cause the potential difference between the grain and the grain boundary to accelerate seawater corrosion. 2, The anti-fouling effect of the Cu element is directly related to the existing form of the Cu element. Compared with the Cu element in a solid solution state, the Cu element in precipitation or segregation state can promote the emission of Cu ions and realize the prevention and killing of microorganisms. It is easy to see that the above two difficulties are contradictory. Therefore, the research and development of multi-functional marine engineering metals have always been a bottleneck technical problem in the world.

Focusing on this problem, the present disclosure couples a variety of metallographic theories and technical methods to carry out innovative designs. The main innovation is that instead of traditional stainless steel and titanium alloys, the face-centered cubic (FCC) phase high-entropy alloy is used as the matrix. The FCC phase high-entropy alloy used has the following advantages: it contains a variety of corrosion-resistant elements and a simple solid solution structure to achieve corrosion resistance. Compared with the body-centered cubic (BCC) phase alloy, it has excellent plasticity. Compared with the traditional corrosion-resistant plastic alloy, it has high mixing entropy and structural metastable property. Entropy and free energy are important physical parameters to change the mutual solubility of alloy and Cu, which provides a theoretical possibility for regulating the morphology of the Cu element.

However, the FCC phase high-entropy alloys containing Cu prepared by techniques such as as-cast, directional solidification, laser cladding, and spraying, as well as post-processed high-entropy alloys, have grain boundary segregation of Cu (as shown in FIGS. 13A-13F, see A. Verma, et al., Scripta Materialia, 2019, 161:28-31). The traditional preparation method cannot solve the phase formation problem caused by chemical inertness, and cannot realize the adjustment of mutual solubility by entropy and free energy.

To solve this problem, another major innovation of the embodiments described herein is that using high-temperature powder metallurgy and suitable temperature heat treatment, temperature control is used to fully exert the effect of mixing entropy and the influence of entropy and free energy on mutual solubility between elements, to realize controllable distribution of the Cu element in high-plasticity and corrosion-resistant multi-principal alloy. The influence of entropy in a long temperature range is used to overcome the influence of chemical inertness. Based on the role of disorder degree and free energy on the solid solubility and phase stability between elements, the uniform and dispersed nano-precipitation of the Cu element in the alloy is realized.

The specific innovative mechanism is that the mutual solubility of the alloy is improved by using high temperature and high entropy in the powder metallurgy process with sufficiently high temperature. In the subsequent heat treatment process, based on the increase of free energy and sufficient diffusion, the nano-precipitation of the Cu element is realized. The technical problem worth noting is: the alloy can maintain the ideal high mixing entropy structure in the solid-state, that is, it must be sintered below the melting point. b, When the mixing entropy of the alloy system is relatively low, the combined effect of mixing entropy and temperature is low, and it is difficult to achieve effective mutual solubility in the powder metallurgy process. c, When the mixing entropy of the alloy is too high, although the alloy can achieve effective mutual solubility in the powder metallurgy process, the relatively high heat treatment temperature could increase the driving force for precipitation, resulting in precipitates with too large scales If the heat treatment temperature is too low, diffusion becomes slower, which inhibits the formation of precipitates. Therefore, the mixing entropy, sintering temperature, and post-treatment temperature of the alloy must be carefully set and fully coordinated to achieve the ideal nano-Cu precipitation structure.

In conclusion, the disclosed embodiments innovatively couple the new alloy structure, temperature, and entropy, controls the mutual solubility between elements and the free energy of the system, realizes the controllable distribution of nano-precipitation of the anti-fouling element Cu in corrosion-resistant and high-plasticity alloys, and solves the long-term technical problems in the development of multi-functional marine engineering alloys. The obtained multi-principal component alloy with high content of nano-precipitated Cu has high plasticity, strong corrosion-resistance, and excellent anti-fouling property, which plays an important role in the development of China's marine equipment engineering.

SUMMARY

Embodiments of the present disclosure provide a preparation method for a multi-functional marine engineering alloy, which realizes the nano-precipitation distribution of the high-content anti-fouling element Cu in the corrosion-resistant and high-plasticity alloy.

The present disclosure is implemented in the following steps:

1) Mixed Ball Milling weighing Co—Cr—Fe—Ni FCC-based high-entropy alloy powder and Cu powder separately, loading the weighed metal powder into a ball milling tank for mixed ball milling and conducting drying treatment after the ball milling to obtain uniform pre-sintered powder;

2) High-Temperature Sintering to Promote Mutual Solubility loading the obtained mixed powder into a graphite die, placing the graphite die in a spark plasma sintering (SPS) furnace, conducting pressure sintering in a vacuum environment or under the protection of inert gas at 1,000-1,500° C., and cooling a sintered material to a room temperature with the furnace after the sintering;

3) Heat Treatment to Induce Nano-Precipitation placing the prepared high-temperature sintered material in a heat treatment furnace, conducting heat preservation heat treatment at 650-950° C., and water cooling or cooling with the furnace after the heat treatment to obtain the multi-functional marine engineering alloy.

As a further preferable implementation solution, components of a Co—Cr—Fe—Ni FCC-based high-entropy alloy may be in equimolar or nearly molar ratios and may have molar percentages of Co(a)Cr(b)Fe(c)Ni(d), $a+b+c+d=100$, $30\geq a\geq 20$, $30\geq b\geq 20$, $30\geq c\geq 20$, $30\geq d\geq 20$. The Co—Cr—Fe—Ni FCC-based high-entropy alloy powder may be obtained by atomizing the Co—Cr—Fe—Ni FCC-based high-entropy alloy, may be spherical, and may have a particle size of 15-100 μm.

In a specific example, the Co—Cr—Fe—Ni FCC-based high-entropy alloy powder is obtained by atomization in the following methods. A Co—Cr—Fe—Ni FCC-based high-entropy alloy bulk is placed in atomizing powder-making equipment for atomization. The equipment is vacuumized to be less than 10 Pa and then filled with high-purity argon gas for protection. A tundish is subjected to heat preservation at 1,400° C. for 25-30 min. The alloy is refined at 1,550-1,600° C. for 4-5 min. The alloy is poured into the tundish. A metal liquid flow is pulverized into small droplets by a high-pressure inert gas flow under 3-4 MPa and rapidly condensed into the powder, and the Co—Cr—Fe—Ni FCC-based high-entropy alloy powder is prepared.

As a further preferable implementation solution, the Cu powder may have a purity greater than 99.9% and a particle size of 5-50 μm, and a percentage of the Cu power in mixed powder of the high-entropy alloy powder and the Cu powder may be 5-20 wt. %.

As a further preferable implementation solution, conditions for the ball milling may be as follows: a ball-to-powder ratio of (1-3):1 and mixing for 10-15 h at 100-350 r/min.

As a further preferable implementation solution, conditions for the high-temperature sintering may be as follows: an atmosphere in the furnace may be vacuumed to $5\times10^{-3}$–10 Pa, or the furnace may be filled with argon gas to 100-1,000 Pa. The graphite die may be pressurized up and down until a sample is under 30-50 MPa. A sintering holding time may be 3-15 min. A heating rate from the room temperature to 1,000° C. may be 30-50° C./min. A heating rate for temperatures greater than 1,000° C. may be 10-20° C./min.

As a further preferable implementation solution, conditions for the heat treatment may be as follows: a heating rate of 5-20° C./min and a holding time of 5-50 h.

The present disclosure has the following beneficial effects:

The Co—Cr—Fe—Ni FCC-based high-entropy alloy is designed as the matrix, and the corrosion resistance, high plasticity, and suitable system mixing entropy of the alloy are realized. Based on the suitable system mixing entropy, sintering is conducted at a high temperature below a melting point. The mutual solubility is improved and the free energy of the system is stabilized by using high temperature and high entropy, which promotes mutual solubility of high-entropy alloys and Cu, and avoids large grain boundary segregation of Cu. Based on the combination of suitable mixing entropy and heat treatment temperature, uniform and dispersed precipitation of nano-sized Cu is achieved in metastable Cu solid solution high-entropy alloys. Using the FCC-based high-entropy alloy with an appropriate disorder degree, coupled with the advantages of high-temperature sintering and heat treatment and aging processes, the multi-functional marine engineering alloy with a large number of corrosion-resistant element compositions, an FCC-based high-plasticity matrix structure, and dispersed nano-precipitation of anti-fouling Cu element is obtained.

The alloy is a metastable FCC-based structure with many easy sliding slip systems, showing high plasticity. The atomized particles maintain the physicochemical properties of the FCC-based high-entropy alloys. The solid solution strengthening and dispersed Cu nano-precipitates of the multi-principal alloy ensure that the alloy has relatively high yield strength. The alloy avoids the grain boundary segregation of Cu, and the corrosion-resistant elements of Cr, Co, and Ni are uniformly distributed, showing excellent corrosion resistance. The alloy contains 5-20 wt. % of uniform and dispersed anti-fouling Cu nano-precipitates, showing excellent anti-fouling property. The method of the present disclosure not only prepares high-strength, high-plasticity, anti-fouling, and corrosion-resistant metal materials suitable for marine operations but also solves the problem of developing multi-functional marine engineering materials. Moreover, it provides an innovative idea with important guidance for regulating the distribution of elements prone to segregation in alloys, especially for the transformation from undesired large grain boundary segregation to ideal dispersed nano-precipitation.

BRIEF DESCRIPTION OF THE DRAWINGS

FIGS. 3A-3E show pictures of 5,000-fold high-power structure morphology and surface distribution of element compositions in a grain in the 85 wt. % [Co(25)Cr(25)Fe(25)Ni(25)]+15 wt. % Cu alloy in Example 1.

DETAILED DESCRIPTION OF THE EMBODIMENTS

Figure 1:
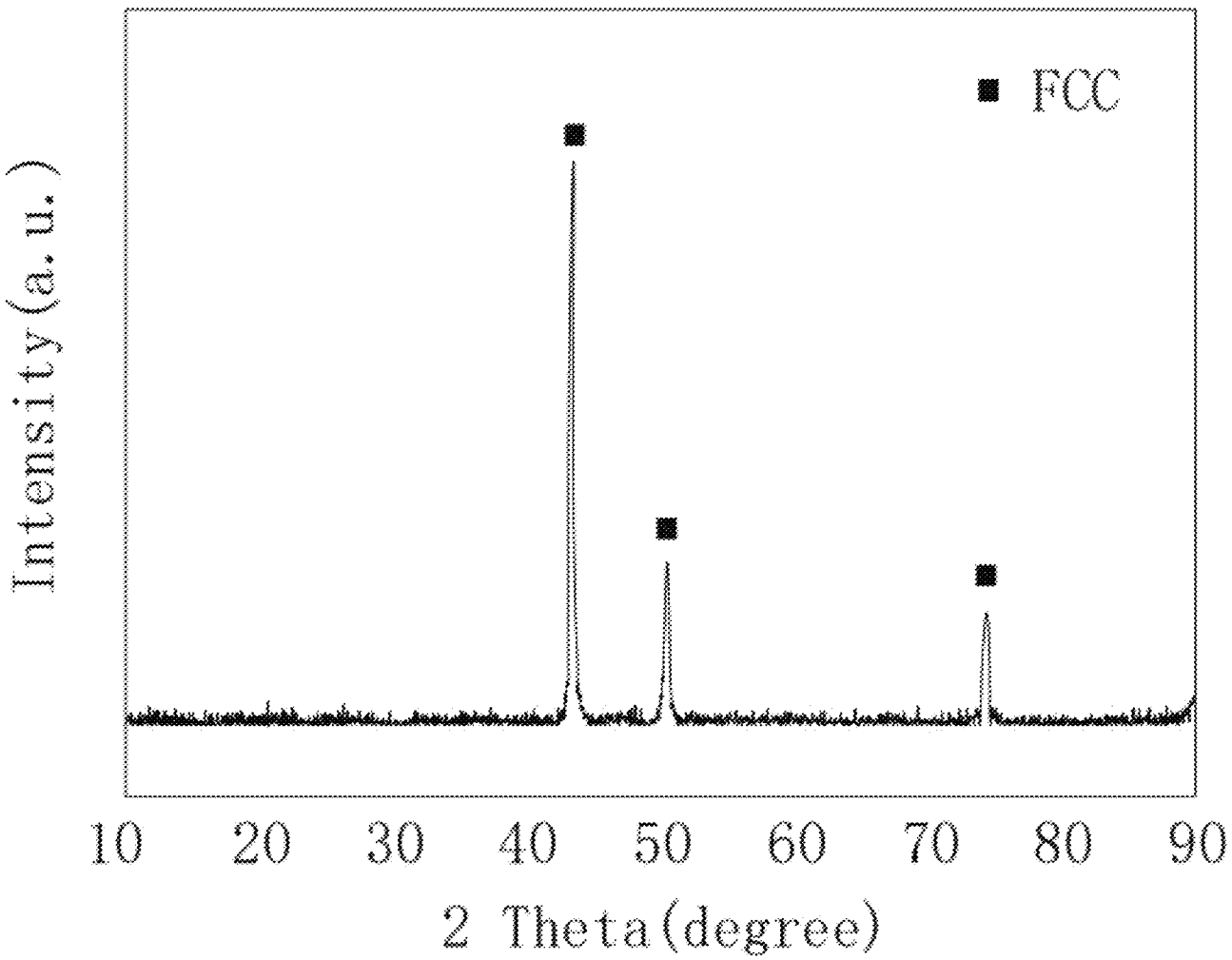
FIG. 1 is an X-ray diffraction (XRD) pattern of an 85 wt. % [Co(25)Cr(25)Fe(25)Ni(25)]+15 wt. % Cu alloy in Example 1.

The technical solutions of the present disclosure will be clearly and completely described below in conjunction with specific examples of the present disclosure and accompanying drawings. The described examples are only a part of, not all of, the examples of the present disclosure. All other examples obtained by those of ordinary skill in the art based on the examples of the present disclosure without creative efforts shall fall within the protection scope of the present disclosure.

Example 1

A preparation method of a multi-functional marine engineering alloy, an 85 wt. % [Co(25)Cr(25)Fe(25)Ni(25)]+15 wt. % Cu alloy, was as follows.

1) Mixed Ball Milling 85 wt. % Co(25)Cr(25)Fe(25)Ni(25) FCC-based high-entropy alloy powder and 15 wt. % Cu powder were weighed with an electronic scale. The high-entropy alloy powder was atomized alloy powder, was spherical, and had a particle size of 15-100 μm. The Cu powder had a purity greater than 99.9% and a particle size of 5-50 μm. The weighed metal powder was loaded into a ball milling tank for mixed ball milling with a ball-to-powder ratio of 2:1 and mixed for 12 h at 200 r/min. Drying treatment was conducted after the ball milling to obtain a uniform pre-sintered powder.

2) High-Temperature Sintering to Promote Mutual Solubility

The obtained mixed powder was loaded into a graphite die, and placed in an SPS furnace. An atmosphere in the furnace was vacuumed to $5\times10^{-3}$ Pa. The graphite die was pressurized up and down until a sample was under 40 MPa. During sintering, the sintering temperature was 1,250° C., the holding time was 10 min, the heating rate from the room temperature to 1,000° C. was 40° C./min, and the heating rate for temperatures greater than 1,000° C. was 15° C./min. A sintered material was cooled to room temperature with the furnace after the sintering.

3) Heat Treatment to Induce Nano-Precipitation

The prepared high-temperature sintered material was placed in a heat treatment furnace. Heat preservation heat treatment was conducted at 800° C. The heating rate was 10° C./min. and a holding time was 20 h. The material was cooled with the furnace after the heat treatment to obtain the multi-functional marine engineering alloy.

Figure 2A:
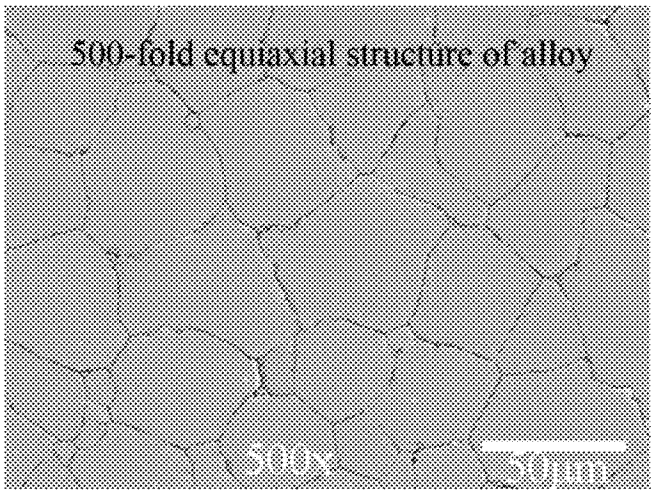
FIGS. 2A-2B show pictures of 500-fold structure morphology and line distribution and surface distribution of a Cu element composition of the 85 wt. % [Co(25)Cr(25)Fe(25)Ni(25)]+15 wt. % Cu alloy in Example 1.
Figure 2B:
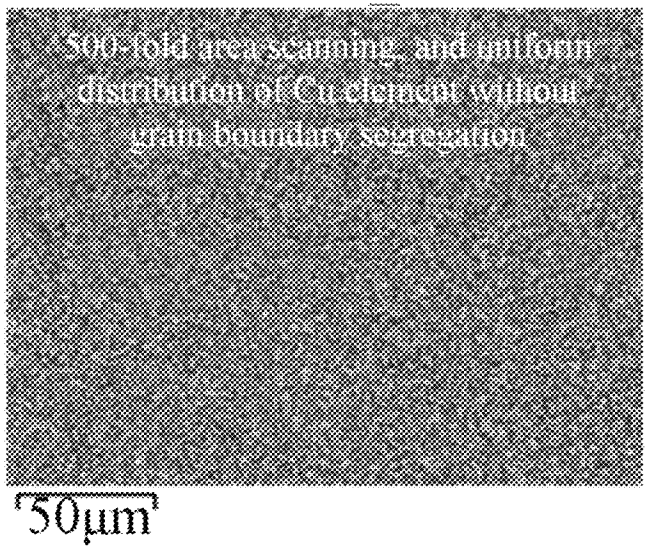

Referring to FIG. 1, X-ray diffraction is conducted on the 85 wt. % [Co(25)Cr(25)Fe(25)Ni(25)]+15 wt. % Cu alloy was obtained in the present example to obtain a diffraction pattern. It can be seen that the material has an FCC structure. Referring to FIGS. 2A-2B, the material obtained in the present example is subjected to 500-fold microstructure observation and composition analysis, the alloy has an equiaxial structure, the Cu element is uniformly distributed, and there is no obvious Cu segregation similar to the as-cast alloy in the Background Art. Referring to FIGS. 3A-3E, 5,000-fold microstructure observation and compositional analysis are conducted in the grain of the material obtained in the present example, and the Cu element of the high-power microstructure presents a uniform and dispersed nano-phase distribution in the grain. The 500-fold and 5,000-fold element distribution prove that not only the grain boundary segregation behavior of Cu is effectively avoided, but also the ideal uniform and dispersed nano-Cu distribution are realized.

Example 2

A preparation method of a multi-functional marine engineering alloy, an 95 wt. % [Co(20)Cr(30)Fe(30)Ni(20)]+5 wt. % Cu alloy, was as follows.

1) Mixed Ball Milling 95 wt. % Co(20)Cr(30)Fe(30)Ni(20) FCC-based high-entropy alloy powder and 5 wt. % Cu powder were weighed with an electronic scale. The high-entropy alloy powder was atomized alloy powder, was spherical, and had a particle size of 15-100 μm. The Cu powder had a purity greater than 99.9% and a particle size of 5-50 μm. The weighed metal powder was loaded into a ball milling tank for mixed ball milling with a ball-to-powder ratio of 1:1 and mixed for 15 h at 100 r/min. Drying treatment was conducted after the ball milling to obtain a uniform pre-sintered powder.

2) High-Temperature Sintering to Promote Mutual Solubility

The obtained mixed powder was loaded into a graphite die, and placed in an SPS furnace. An atmosphere in the furnace was vacuumed to 10 Pa. The graphite die was pressurized up and down until a sample was under 30 MPa. During sintering, the sintering temperature was 1,000° C., the holding time was 15 min, the heating rate from the room temperature to 1,000° C. was 50° C./min, and the heating rate for temperatures greater than 1,000° C. was 20° C./min. A sintered material was cooled to room temperature with the furnace after the sintering.

3) Heat Treatment to Induce Nano-Precipitation

The prepared high-temperature sintered material was placed in a heat treatment furnace. Heat preservation heat treatment was conducted at 650° C. The heating rate was 20° C./min. and a holding time was 50 h. The material was cooled with the furnace after the heat treatment to obtain the multi-functional marine engineering alloy.

Figure 5B:
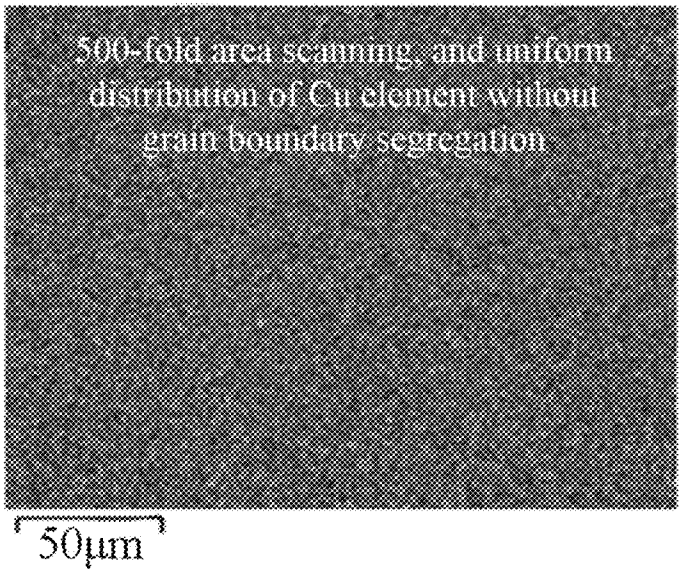
FIGS. 5A-5B show pictures of 500-fold structure morphology and line distribution and surface distribution of a Cu element composition of a 95 wt. % [Co(20)Cr(30)Fe(30)Ni(20)]+5 wt. % Cu alloy in Example 2.
Figure 5A:
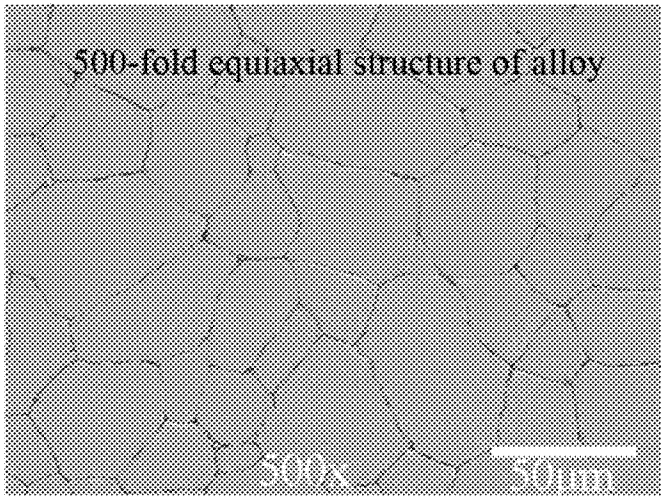
Figure 6D:
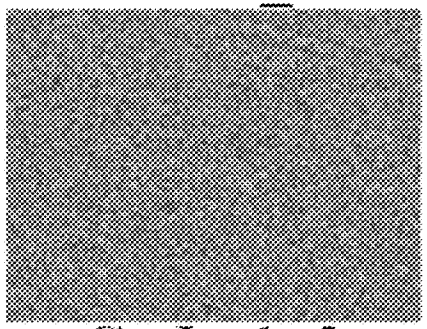
FIGS. 6A-6E show pictures of 5,000-fold high-power structure morphology and surface distribution of element compositions in grain in the 95 wt. % [Co(20)Cr(30)Fe(30)Ni(20)]+5 wt. % Cu alloy in Example 2.
Figure 6E:
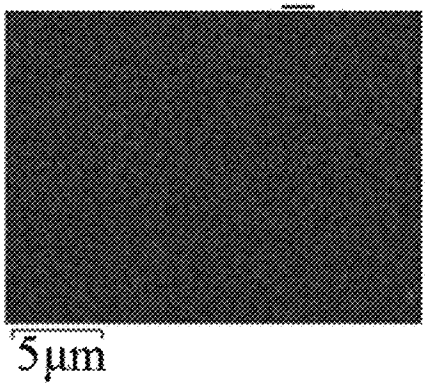
Figure 6C:
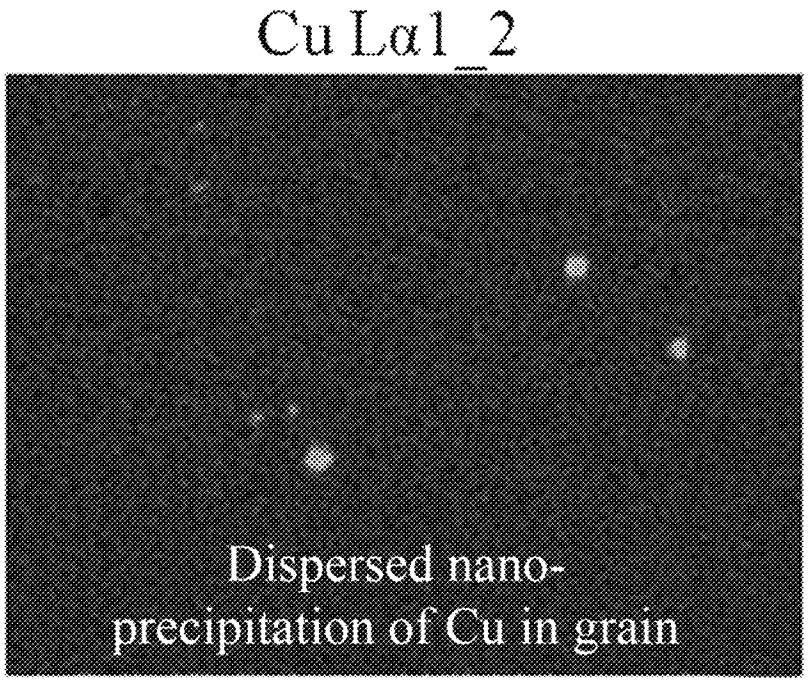
Figure 6B:
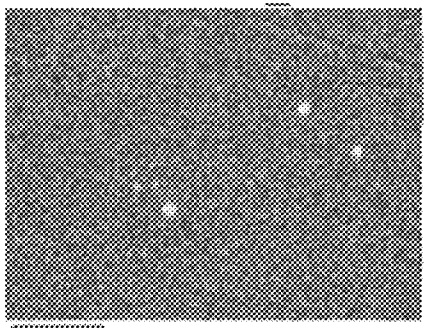
Figure 6A:
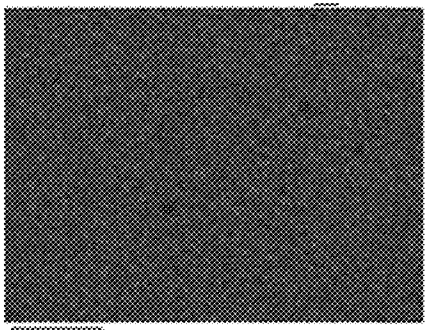

Referring to FIGS. 5A-5B, the 95 wt. % [Co(20)Cr(30)Fe(30)Ni(20)]+5 wt. % Cu alloy obtained in the present example is subjected to 500-fold microstructure observation and composition analysis, the alloy has an equiaxial structure, the Cu element is uniformly distributed, and there is no obvious Cu segregation similar to the as-cast alloy in the Background Art. Referring to FIGS. 6A-6E, 5,000-fold microstructure observation and compositional analysis are conducted in the grain of the material obtained in the present example, and the Cu element of the high-power microstructure presents a uniform and dispersed nano-phase distribution in the grain. The 500-fold and 5,000-fold element distribution prove that not only the grain boundary segregation behavior of Cu is effectively avoided, but also the ideal uniform and dispersed nano-Cu distribution are realized.

Example 3

A preparation method of a multi-functional marine engineering alloy, an 80 wt. % [Co(30)Cr(20)Fe(20)Ni(30)]+20 wt. % Cu alloy, was as follows.

1) Preparation of Co(30)Cr(20)Fe(20)Ni(30) FCC-Based High-Entropy Alloy Powder

A Co(30)Cr(20)Fe(20)Ni(30) FCC-based high-entropy alloy bulk was prepared by arc melting. The Co(30)Cr(20)Fe(20)Ni(30) FCC-based high-entropy alloy bulk was placed in atomizing powder-making equipment. The equipment was vacuumized to be less than 10 Pa and then filled with high-purity argon gas for protection. A tundish was subjected to heat preservation at 1,400° C. for 25 min. The alloy was refined at 1,550° C. for 5 min. The alloy was poured into the tundish. A metal liquid flow was pulverized into small droplets by a high-pressure inert gas flow under 3 MPa and rapidly condensed into the powder, and the Co—Cr—Fe—Ni FCC-based high-entropy alloy powder was prepared.

2) Mixed Ball Milling 80 wt. % Co(30)Cr(20)Fe(20)Ni(30) FCC-based high-entropy alloy powder and 20 wt. % Cu powder was weighed with an electronic scale. The high-entropy alloy powder was atomized alloy powder, was spherical, and had a particle size of 15-100 μm. The Cu powder had a purity greater than 99.9% and a particle size of 5-50 μm. The weighed metal powder was loaded into a ball milling tank for mixed ball milling with a ball-to-powder ratio of 3:1 and mixed for 10 h at 350 r/min. Drying treatment was conducted after the ball milling to obtain a uniform pre-sintered powder.

3) High-Temperature Sintering to Promote Mutual Solubility

The obtained mixed powder was loaded into a graphite die, and placed in an SPS furnace. An atmosphere in the furnace was vacuumed to 5 Pa, and the furnace was filled with argon gas to 100 Pa. Under the atmosphere of argon gas, the graphite die was pressurized up and down until a sample was under 50 MPa. During sintering, the sintering temperature was 1,500° C., the holding time was 3 min, the heating rate from the room temperature to 1,000° C. was 30° C./min, and the heating rate for temperatures greater than 1,000° C. was 10° C./min. A sintered material was cooled to room temperature with the furnace after the sintering.

4) Heat Treatment to Induce Nano-Precipitation

The prepared high-temperature sintered material was placed in a heat treatment furnace. Heat preservation heat treatment was conducted at 950° C. The heating rate was 5° C./min. and a holding time was 5 h. The material was water-cooled after the heat treatment to obtain the multi-functional marine engineering alloy.

Figures 8A, 8B:
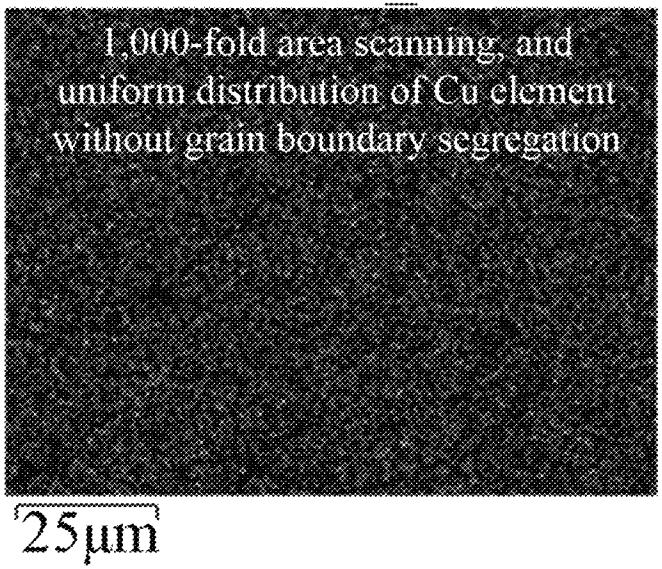
FIGS. 8A-8B show pictures of 1,000-fold structure morphology and line distribution of a Cu element composition of an 80 wt. % [Co(25)Cr(25)Fe(20)Ni(30)]+20 wt. % Cu alloy in Example 3.
Figure 9D:
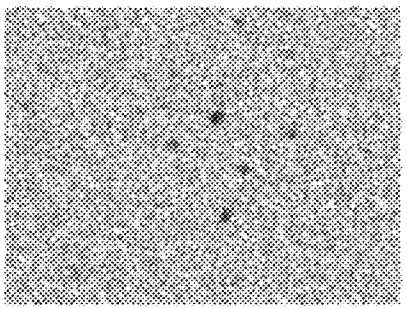
FIGS. 9A-9E show pictures of 5,000-fold high-power structure morphology and surface distribution of element compositions in grain in the 80 wt. % [Co(25)Cr(25)Fe(20)Ni(30)]+20 wt. % Cu alloy in Example 3.
Figure 9E:
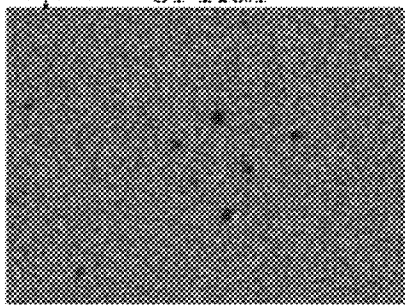
Figure 9C:
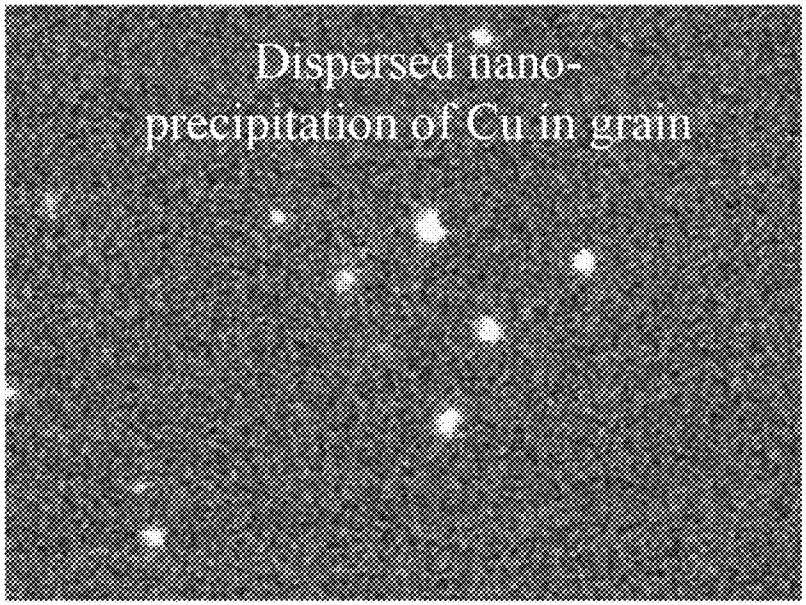
Figure 9B:
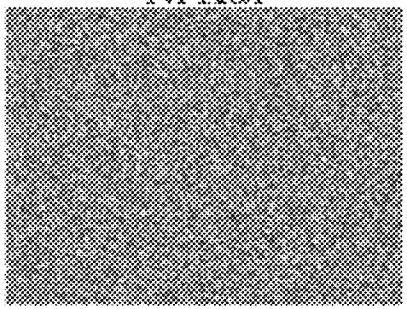
Figure 9A:
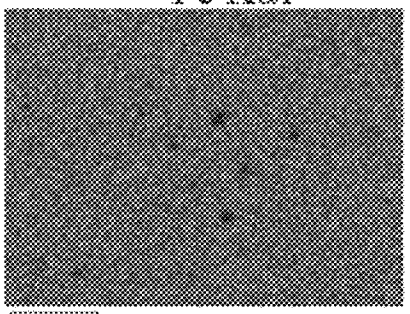

Referring to FIGS. 8A-8B, the 80 wt. % [Co(30)Cr(20)Fe(20)Ni(30)]+20 wt. % Cu alloy obtained in the present example is subjected to 1,000-fold microstructure observation and composition analysis, the alloy has an equiaxial structure, the Cu element is uniformly distributed, and there is no obvious Cu segregation similar to the as-cast alloy in the Background Art. Referring to FIGS. 9A-9E, 5,000-fold microstructure observation and compositional analysis are conducted in the grain of the material obtained in the present example, and the Cu element of the high-power microstructure presents a uniform and dispersed nano-phase distribution in the grain. The 500-fold and 5,000-fold element distribution prove that not only the grain boundary segregation behavior of Cu is effectively avoided, but also the ideal uniform and dispersed nano-Cu distribution are realized.

Example 4

A preparation method of a multi-functional marine engineering alloy, an 90 wt. % [Co(23)Cr(26)Fe(27)Ni(24)]+10 wt. % Cu alloy, was as follows.

1) Preparation of Co(23)Cr(26)Fe(27)Ni(24) FCC-Based High-Entropy Alloy Powder

A Co(23)Cr(26)Fe(27)Ni(24) FCC-based high-entropy alloy bulk was prepared by arc melting. The Co(23)Cr(26)Fe(27)Ni(24) FCC-based high-entropy alloy bulk was placed in atomizing powder-making equipment. The equipment was vacuumized to be less than 5 Pa and then filled with high-purity argon gas for protection. A tundish was subjected to heat preservation at 1,400° C. for 30 min. The alloy was refined at 1,600° C. for 4 min. The alloy was poured into the tundish. A metal liquid flow was pulverized into small droplets by a high-pressure inert gas flow under 4 MPa and rapidly condensed into the powder, and the Co—Cr—Fe—Ni FCC-based high-entropy alloy powder was prepared.

2) Mixed Ball Milling 90 wt. % Co(23)Cr(26)Fe(27)Ni(24) FCC-based high-entropy alloy powder and 10 wt. % Cu powder was weighed with an electronic scale. The high-entropy alloy powder was atomized alloy powder, was spherical, and had a particle size of 15-100 μm. The Cu powder had a purity greater than 99.9% and a particle size of 5-50 μm. The weighed metal powder was loaded into a ball milling tank for mixed ball milling with a ball-to-powder ratio of 2:1 and mixed for 13 h at 150 r/min. Drying treatment was conducted after the ball milling to obtain a uniform pre-sintered powder.

3) High-Temperature Sintering to Promote Mutual Solubility

The obtained mixed powder was loaded into a graphite die, and placed in an SPS furnace. An atmosphere in the furnace was vacuumed to $2\times10^{-2}$ Pa, and the furnace was filled with argon gas to 100 Pa. The graphite die was pressurized up and down until a sample was under 35 MPa. During sintering, the sintering temperature was 1,400° C., the holding time was 6 min, the heating rate from the room temperature to 1,000° C. was 30° C./min, and the heating rate for temperatures greater than 1,000° C. was 15° C./min. A sintered material was cooled to room temperature with the furnace after the sintering.

4) Heat Treatment to Induce Nano-Precipitation

The prepared high-temperature sintered material was placed in a heat treatment furnace. Heat preservation heat treatment was conducted at 750° C. The heating rate was 15° C./min. and a holding time was 30 h. The material was water-cooled after the heat treatment to obtain the multi-functional marine engineering alloy.

The 90 wt. % [Co(23)Cr(26)Fe(27)Ni(24)]+10 wt. % Cu alloy obtained in the present example has an equiaxial structure, the Cu element is uniformly distributed, and there is no obvious Cu segregation similar to the as-cast alloy in the Background Art. The Cu element presents a uniform and dispersed nano-phase distribution in the grain. The grain boundary segregation behavior of Cu is effectively avoided, and the ideal uniform and dispersed nano-Cu distribution are realized.

Example 5

A preparation method of a multi-functional marine engineering alloy, an 88 wt. % [Co(24)Cr(26)Fe(23)Ni(27)]+12 wt. % Cu alloy, was as follows.

1) Mixed Ball Milling 88 wt. % Co(24)Cr(26)Fe(23)Ni(27) FCC-based high-entropy alloy powder and 12 wt. % Cu powder were weighed with an electronic scale. The high-entropy alloy powder was atomized alloy powder, was spherical, and had a particle size of 15-100 μm. The Cu powder had a purity greater than 99.9% and a particle size of 5-50 μm. The weighed metal powder was loaded into a ball milling tank for mixed ball milling with a ball-to-powder ratio of 1:1 and mixed for 11 h at 300 r/min. Drying treatment was conducted after the ball milling to obtain a uniform pre-sintered powder.

2) High-Temperature Sintering to Promote Mutual Solubility

The obtained mixed powder was loaded into a graphite die, and placed in an SPS furnace. An atmosphere in the furnace was vacuumed to $1\times10^{-1}$ Pa. The graphite die was pressurized up and down until a sample was under 45 MPa. During sintering, the sintering temperature was 1,200° C., the holding time was 12 min, the heating rate from the room temperature to 1,000° C. was 30° C./min, and the heating rate for temperatures greater than 1,000° C. was 15° C./min. A sintered material was cooled to room temperature with the furnace after the sintering.

3) Heat Treatment to Induce Nano-Precipitation

The prepared high-temperature sintered material was placed in a heat treatment furnace. Heat preservation heat treatment was conducted at 850° C. The heating rate was 10° C./min. and a holding time was 10 h. The material was cooled with the furnace after the heat treatment to obtain the multi-functional marine engineering alloy.

The 88 wt. % [Co(24)Cr(26)Fe(23)Ni(27)]+12 wt. % Cu alloy obtained in the present example has an equiaxial structure, the Cu element is uniformly distributed, and there is no obvious Cu segregation similar to the as-cast alloy in the Background Art. The Cu element presents a uniform and dispersed nano-phase distribution in the grain. The grain boundary segregation behavior of Cu is effectively avoided, and the ideal uniform and dispersed nano-Cu distribution are realized.

Test Example

1. Mechanical Property Test

Taking the materials prepared in Example 1, Example 2, Example 3, Example 4, and Example 5 as the test group, the room temperature compressive property test of the material was conducted.

The room temperature compressive property analysis of the material was conducted using a universal material testing machine (INSTRON3382, USA). Before the compressive test, the material was prepared into a 4 mm (diameter)×8 mm (height) cylindrical sample using machining equipment, the surface and both ends of the sample were polished to ensure that the lower side of the sample was vertical and the upper and lower ends of the sample were parallel, and the sample was cleaned with anhydrous ethanol. Under the condition of a strain rate of $1\times10^{-4}$ $s^{-1}$, the room temperature compressive property of the material was tested. The size of the sample before and after the test was measured with a vernier caliper. During the test, the universal material testing machine automatically recorded the deformation and applied pressure to the sample.

Figure 4:
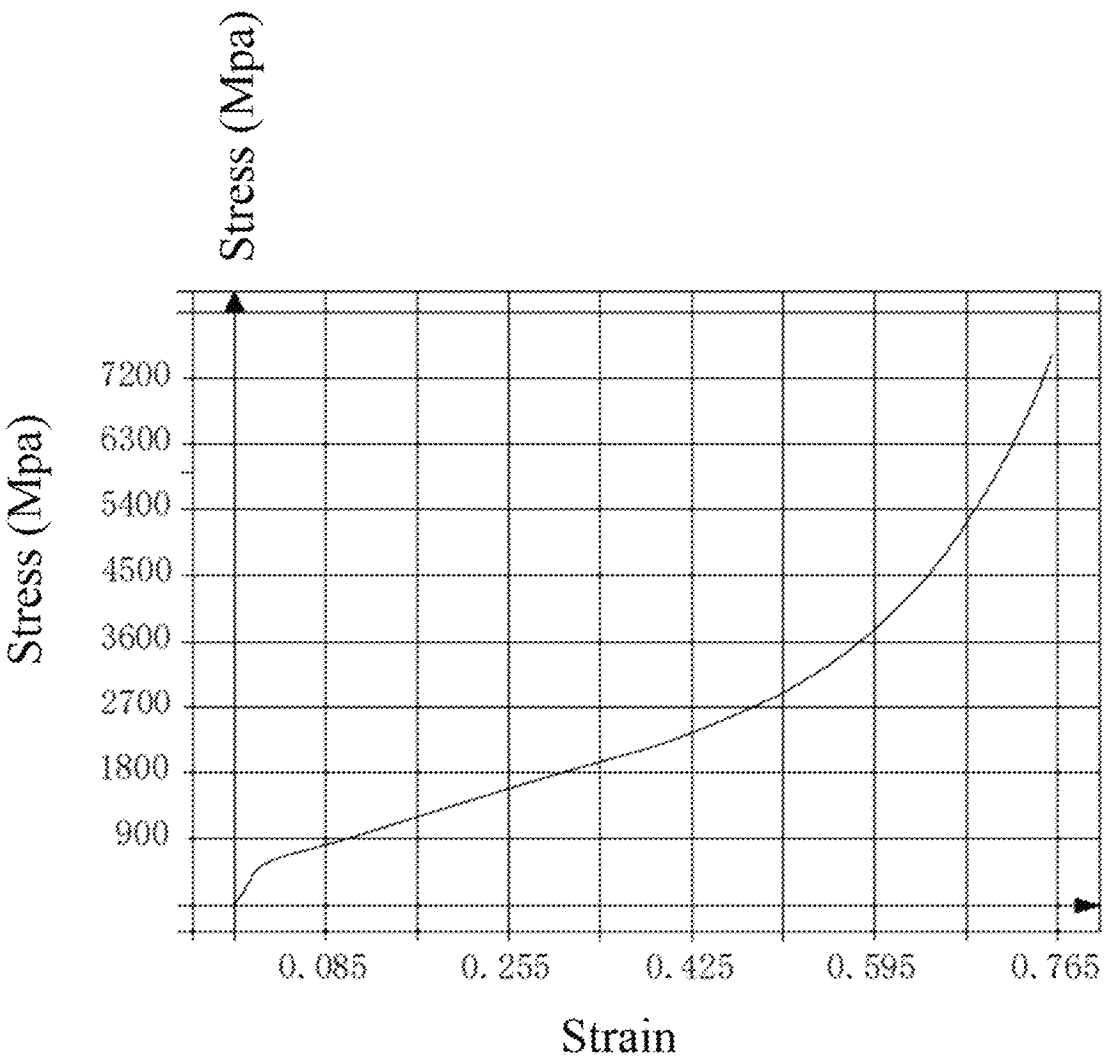
FIG. 4 shows a room-temperature compressive property curve of the 85 wt. % [Co(25)Cr(25)Fe(25)Ni(25)]+15 wt. % Cu alloy in Example 1.
Figure 7:
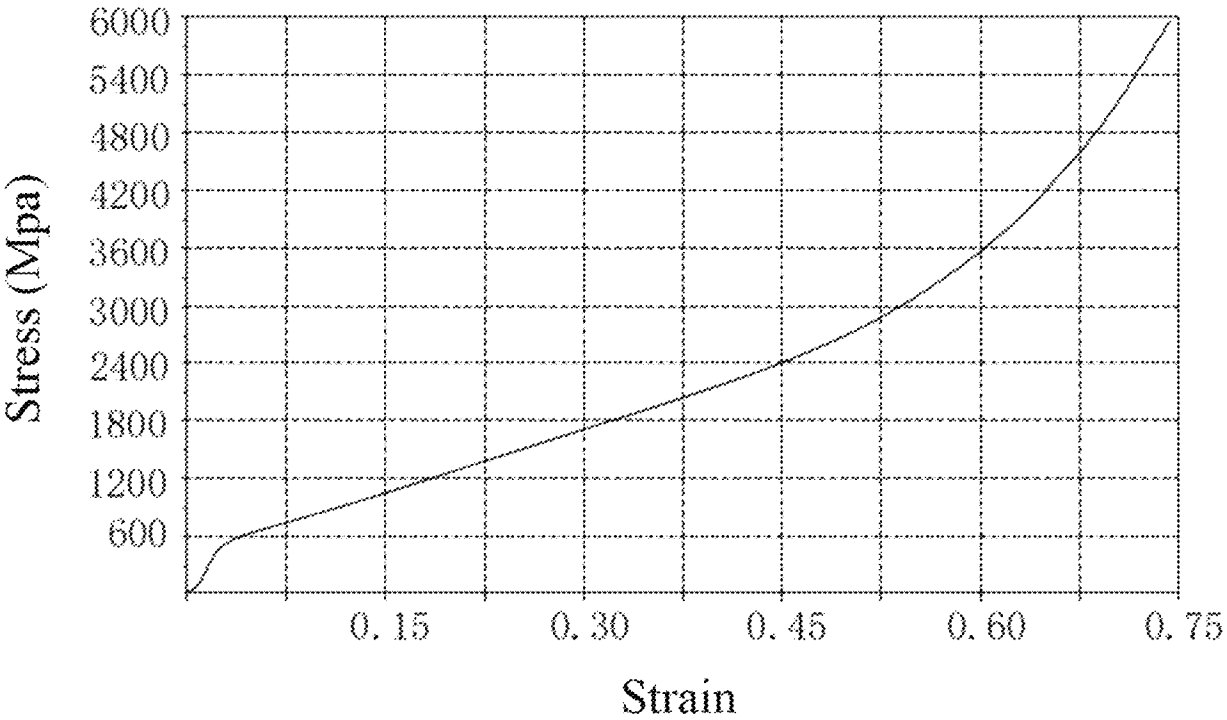
FIG. 7 shows a room-temperature compressive property curve of the 95 wt. % [Co(20)Cr(30)Fe(30)Ni(20)]+5 wt. % Cu alloy in Example 2.
Figure 10:
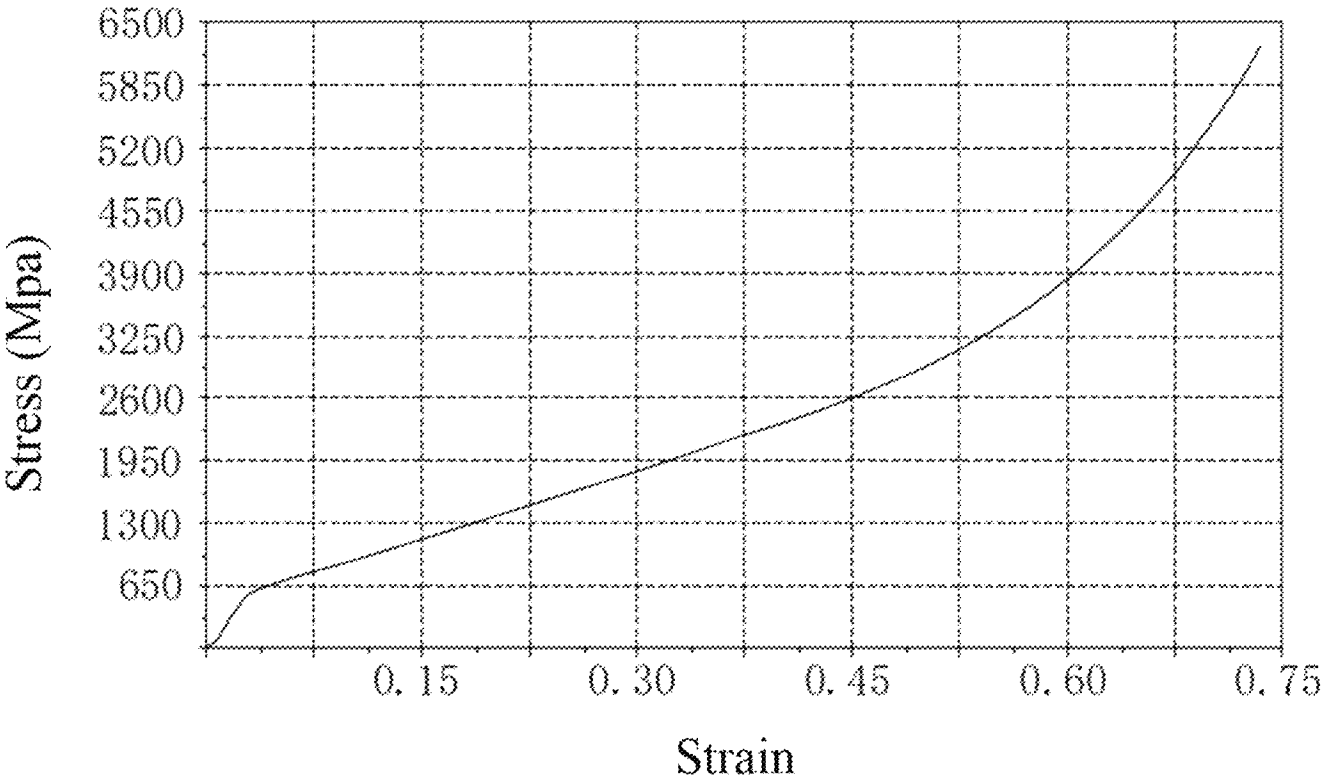
FIG. 10 shows a room-temperature compressive property curve of the 80 wt. % [Co(25)Cr(25)Fe(20)Ni(30)]+20 wt. % Cu alloy in Example 3.
Figure 11A:
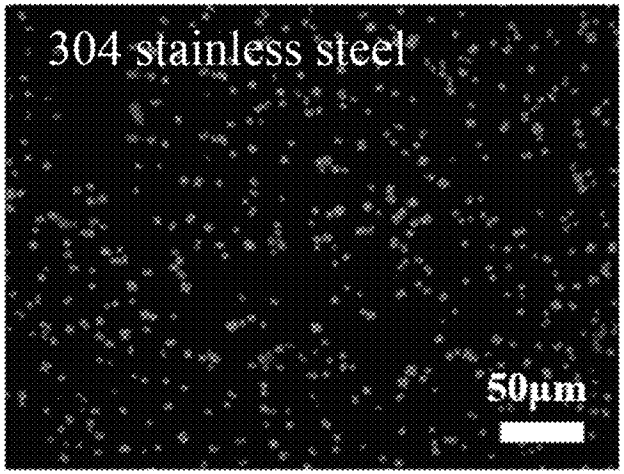
FIGS. 11A-11D show an average algae deposition in artificial seawater of a multi-functional marine engineering alloy obtained in Examples 1 to 3.
Figure 11B:
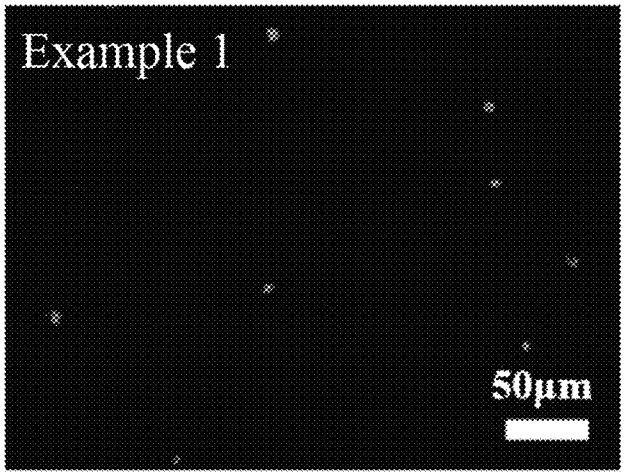
Figure 11C:
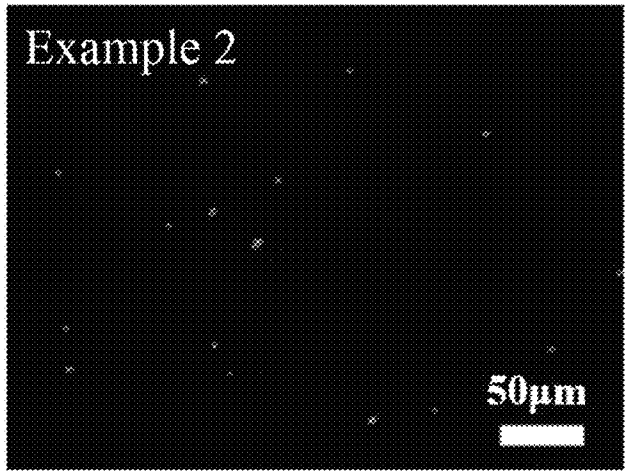
Figure 11D:
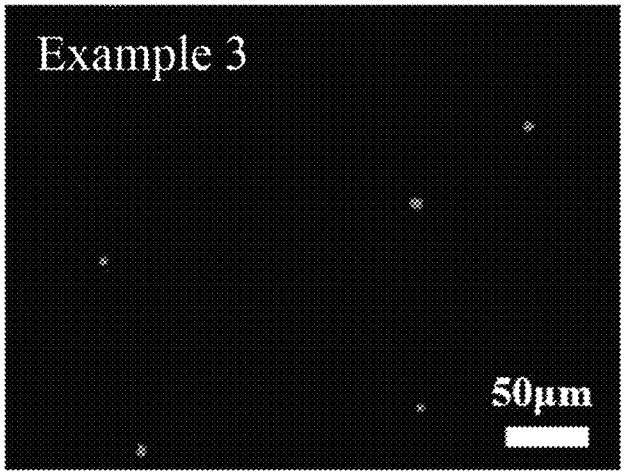

The test results are shown in FIG. 4, FIG. 7, FIG. 10, and Table 1.

TABLE 1

Room temperature compressive property of multi-functional marine engineering alloys obtained in Examples 1 to 3.

| Group | Yield strength (MPa) | Deformation before fracture (%) |
|---|---|---|
| Example 1 | 572 | >75% |
| Example 2 | 523 | >75% |
| Example 3 | 587 | >75% |
| Example 4 | 547 | >75% |
| Example 5 | 556 | >75% |

Referring to FIG. 4, FIG. 7, and FIG. 10, the compressive plasticity of the materials obtained in Examples 1 to 3 exceeds 75%. It can be seen from Table 1 that the multi-functional marine engineering materials obtained in Examples 1 to 5 have a yield strength higher than 520 Mpa. With the increase of Cu content, the Cu nano-precipitates increase, and the yield strength of the alloy shows an increasing trend. It can be seen that the multi-functional marine engineering alloys prepared in Examples 1 to 5 have high yield strength and high plasticity.

2. Anti-Fouling Property Test

Taking the materials prepared in Example 1, Example 2, Example 3, Example 4, and Example 5 as the test group, and taking the currently serving marine engineering material 304 stainless steel as the control group, a comparative test of the anti-fouling property was conducted.

The anti-fouling test was conducted at 25° C. with the green algae D. tertiolectag. After equilibrating in seawater, the samples were transferred into a sterile water cup containing 5 mL of seaweed suspension and placed at a constant temperature of 25° C. for 24 h, and the surface of the samples after the determination was rinsed with artificial sterile seawater for 3 times. The algae adhered to the surface of the samples and were characterized using automated fluorescence image analysis (Olympus, BX-51, Japan).

The test results are shown in FIGS. 11A-11D. The 304 stainless steel of the control group was in seawater, and a large number of algae adhered to the surface, and the average algae deposition was about 2,027/$mm^2$. The algae adhered to the surface of the multi-functional marine engineering alloy as the test group was significantly less than that of 304 stainless steel. With the increase of the content of the Cu element, the number of algae adhered to the surface further decreased. The average algae deposition of 95 wt. % [Co(20)Cr(30)Fe(30)Ni(20)]+5 wt. % Cu obtained in Example 2 was about 247/mm$^2$. The average algae deposition of 85 wt. % [Co(25)Cr(25)Fe(25)Ni(25)]+15 wt. % Cu obtained in Example 1 was about 129/mm$^2$. The average algae deposition of 80 wt. % [Co(30)Cr(20)Fe(20)Ni(30)]+20 wt. % Cu obtained in Example 3 was about 97/mm$^2$. In addition, through tests and measurements, the average algae deposition of the alloys prepared in Example 4 and Example 5 was 183/mm$^2$ and 167/mm$^2$. It could be seen that the multi-functional marine engineering alloys prepared in Examples 1 to 5 had good anti-fouling properties.

3. Corrosion Resistance Test

Taking the materials prepared in Example 1, Example 2, Example 3, Example 4, and Example 5 as the test group, and taking the currently serving marine engineering material 304 stainless steel as the control group, a comparative test of corrosion resistance was conducted.

Corrosion analysis was conducted in artificial seawater using an electrochemical workstation (AUTO LAB PGSTAT 320N, Switzerland). The artificial seawater was prepared according to the ASTM-141-98 standard. Before electrochemical testing, the samples were mechanically ground with 1200 grit SiC paper and washed with ethanol. A dynamic potential polarization test at a scan rate of 1 mV/s and electrochemical impedance spectroscopy (EIS) measurement at open circuit potential was conducted at room temperature. An Ag/AgCl electrode and a plate electrode in a saturated KCl solution were used as a reference electrode and a counter electrode separately.

The test results are shown in Table 2.

TABLE 2

Electrochemical property of multi-functional marine engineering alloys obtained in Examples 1 to 3 in artificial seawater.

| | Group | Temperature | | |
|---|---|---|---|---|
| | | icoor(μA/cm$^2$) | Ecoor(V) | $R_{et}$(kΩ · cm$^2$) |
| Test group | Example 1 | 2.71 | −0.317 | 23 |
| | Example 2 | 1.83 | −0.279 | 26 |
| | Example 3 | 3.17 | −0.331 | 22 |
| | Example 4 | 2.36 | −0.294 | 24 |
| | Example 5 | 2.59 | −0.301 | 24 |
| Control group | 304 stainless steel | 3.16 | −0.323 | 22 |

It can be seen from Table 2 that the 304 stainless steel in the control group in artificial seawater has a corrosion current of 3.16 μA/cm$^2$, a corrosion potential of −0.323 V, and $R_{ct}$ of 22 kΩ cm$^2$. As the high multi-functional marine engineering alloy of the test group, 80 wt. % [Co(30)Cr(20)Fe(20)Ni(30)]+20 wt. % Cu in Example 3 has a corrosion potential and $R_{ct}$ close to those of the 304 stainless steel, a corrosion current slightly higher than that of the 304 stainless steel, and corrosion resistance close to that of the 304 stainless steel. The corrosion resistance of the alloys of Example 1, Example 2, Example 4, and Example 5 is superior to that of the 304 stainless steel. The corrosion current of Example 2 is close to 60% of that of the 304 stainless steel, and the $R_{ct}$ is 18% higher than that of the 304 stainless steel. It can be seen that the multi-functional marine engineering alloys prepared in Examples 1 to 5 have excellent seawater corrosion resistance.

Figures 12A, 12B:
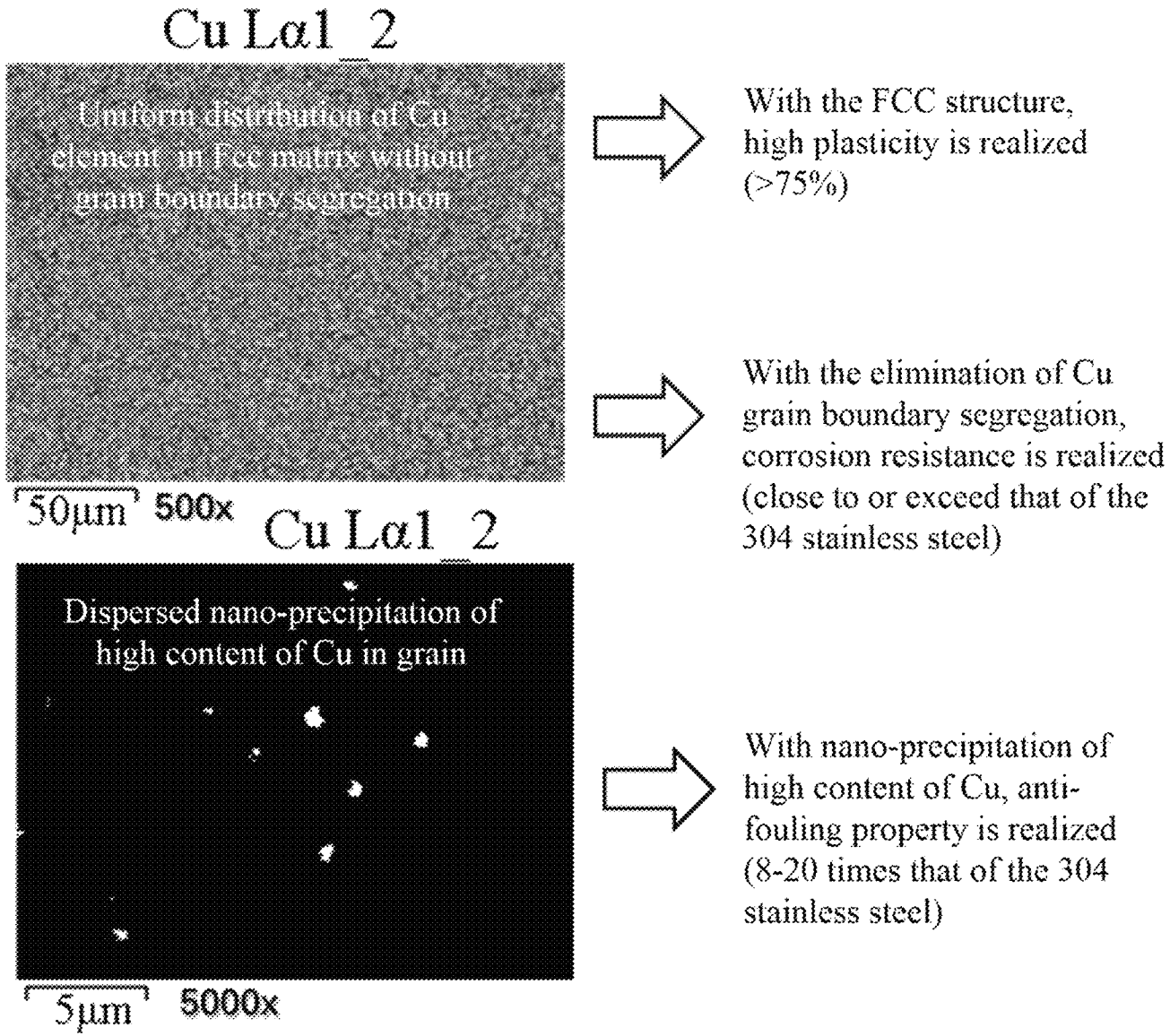
FIGS. 12A-12B are a property realization mechanism diagram of the multi-functional marine engineering alloy.
Figures 13A, 13B, 13C, 13D, 13E, 13F:
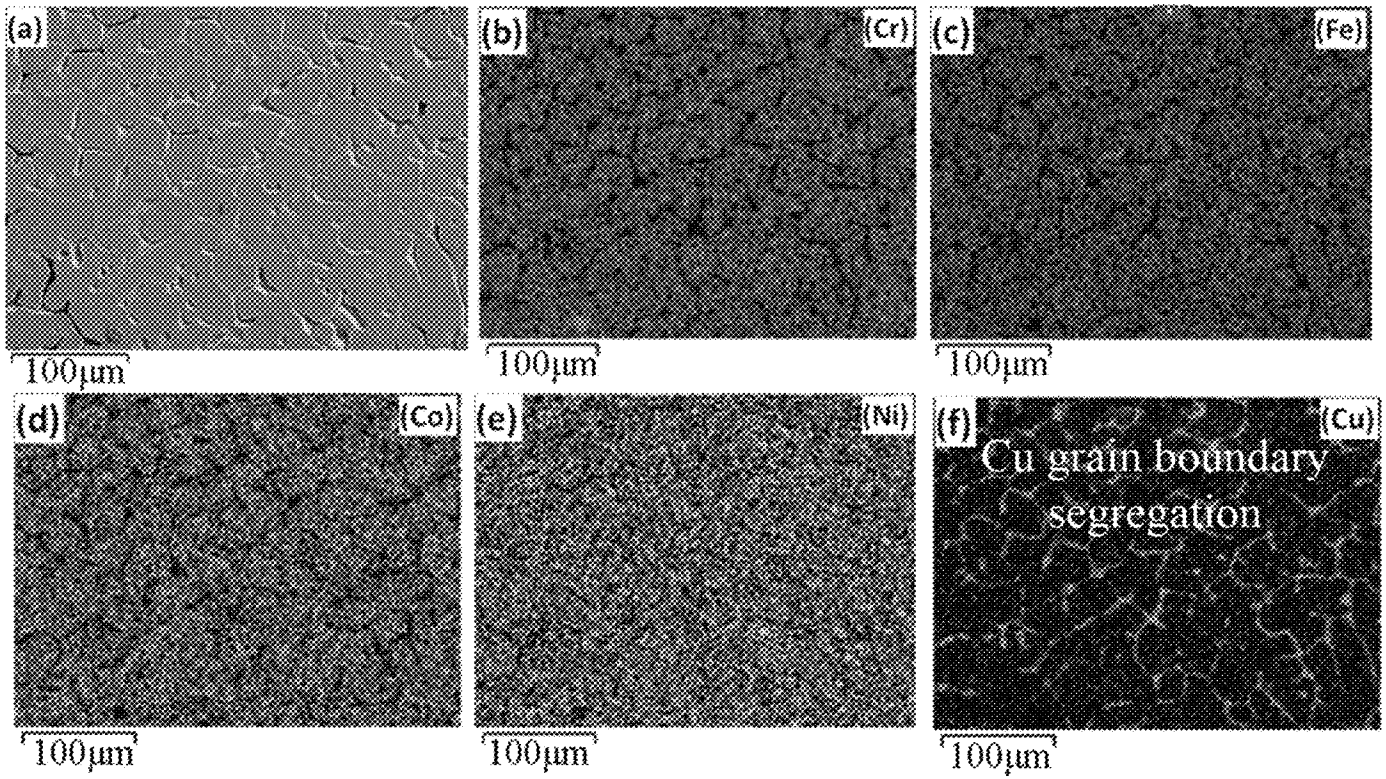
FIGS. 13A-13F show a microstructure (a) and distribution of element compositions (b-f) of an as-cast CoCrFeNi—Cu alloy.

In the FCC phase multi-principal alloy with high content of nano-precipitated Cu prepared by the present disclosure, with the FCC phase structure, the high plasticity of the alloy is realized, exceeding 75%. With the strengthening effect of the nano-precipitation of the Cu element, the higher strength of the alloy is realized, and the yield strength is greater than 520 MPa. With the elimination of Cu segregation and the large content of corrosion-resistant elements of Cr, Co, and Ni, the excellent seawater corrosion resistance of the alloy is realized, and the corrosion resistance is close to or exceeds that of the 304 stainless steel. With the addition of the high content of the Cu element and the uniform and dispersed nano-phase distribution of the Cu element, the excellent marine anti-fouling property of the alloy is realized, which is about 8-20 times that of the 304 stainless steel (see FIGS. 12A-12B).

The above described are merely preferred examples of the present disclosure, and are not intended to limit the present disclosure. Any modifications, equivalent replacements, and improvements made within the spirit and principle of the present disclosure should all fall within the protection scope of the present disclosure.

What is claimed is:

1. A preparation method of a multi-functional marine engineering alloy, comprising the following steps:

performing a mixed ball milling step comprising:

weighing Co—Cr—Fe—Ni face-centered cubic (FCC)-based high-entropy alloy powder and Cu powder separately;

loading the weighed Co—Cr—Fe—Ni FCC-based high-entropy alloy powder and Cu powder into a ball milling tank for mixed ball milling; and conducting drying treatment after the ball milling to obtain a mixed powder;

performing a high-temperature sintering step to promote mutual solubility, the high-temperature sintering step comprising:

loading the obtained mixed powder into a graphite die, placing the graphite die in a spark plasma sintering (SPS) furnace;

conducting pressure sintering in a vacuum environment or under protection of inert gas at 1,000-1,500° C. to obtain a sintered material; and cooling the sintered material to a room temperature with the furnace after the sintering; and performing a heat treatment step to induce nano-precipitation, the heat treatment step comprising:

placing the sintered material in a heat treatment furnace;

conducting heat preservation heat treatment at 650-950° C.; and water cooling or cooling with the furnace after the heat treatment to obtain the multi-functional marine engineering alloy, wherein components of the Co—Cr—Fe—Ni FCC-based high-entropy alloy are in equimolar or nearly molar ratios and have molar percentages of Co(a)Cr(b)Fe(c)Ni(d), a+b+c+d=100, 30≥a≥20, 30≥b≥20, 30≥c≥20, 30≥d≥20, and a percentage of the Cu powder in the mixed powder of the Co—Cr—Fe—Ni FCC-based high-entropy alloy powder and the Cu powder is 5-20 wt. %.

2. The preparation method of a multi-functional marine engineering alloy according to claim 1, wherein the Co—Cr—Fe—Ni FCC-based high-entropy alloy powder is obtained by atomizing the Co—Cr—Fe—Ni FCC-based high-entropy alloy, is spherical, and has a particle size of 15-100 μm.

3. The preparation method of a multi-functional marine engineering alloy according to claim 1, wherein the Cu powder has a purity greater than 99.9% and a particle size of 5-50 μm, and a percentage of the Cu powder in the mixed powder of the high-entropy alloy powder and the Cu powder is 5-20 wt. %.

4. The preparation method of a multi-functional marine engineering alloy according to claim 1, wherein conditions for the ball milling are as follows: a ball-to-powder ratio of (1-3): 1 and mixing for 10-15 h at 100-350 r/min.

5. The preparation method of a multi-functional marine engineering alloy according to claim 1, wherein conditions for the sintering comprise:

an atmosphere in the furnace that is vacuumed to $5\times10^{-3}$-10 Pa, or the furnace is filled with argon gas to 100-1,000 Pa, and wherein the graphite die is pressurized up and down until a sample is under 30-50 MPa, a sintering holding time is 3-15 min, a heating rate from the room temperature to 1,000° C. is 30-50° C./min, and a heating rate for temperatures greater than 1,000° C. is 10-20° C./min.

6. The preparation method of a multi-functional marine engineering alloy according to claim 1, wherein conditions for the heat treatment are as follows: a heating rate of 5-20° C./min and a holding time of 5-50 h.

* * * * *